US005820296A

United States Patent [19]

Goughnour

[11] Patent Number: 5,820,296

[45] Date of Patent: Oct. 13, 1998

[54] PREFABRICATED VERTICAL EARTH DRAIN AND METHOD OF MAKING THE SAME

[76] Inventor: R. Robert Goughnour, 705 Duff Rd., NE., Leesburg, Va. 22075

[21] Appl. No.: 644,125

[22] Filed: May 10, 1996

[51] Int. Cl.[6] ..... E02B 11/00; E02D 19/00

[52] U.S. Cl. ..... 405/43; 52/169.5; 405/49

[58] Field of Search ..... 405/43, 45, 49, 405/271; 52/169.5, 408

[56] References Cited

U.S. PATENT DOCUMENTS

| | | | |
|---|---|---|---|
| 1,598,300 | 8/1926 | Moran | 405/271 |
| 4,574,541 | 3/1986 | Raidt et al. | 405/45 X |
| 4,749,306 | 6/1988 | Demeny et al. | 405/45 |
| 4,943,185 | 7/1990 | McGuckin et al. | 405/45 |
| 5,213,449 | 5/1993 | Morris | 405/232 |
| 5,489,462 | 2/1996 | Sieber | 405/45 X |

*Primary Examiner*—Tamara L. Graysay
*Assistant Examiner*—Tara L. Mayo
*Attorney, Agent, or Firm*—Carothers & Carothers

[57] ABSTRACT

A prefabricated composite vertical earth drain which has an elongated corrugated flexible plastic core sheet with horizontal corrugations that provide continuous longitudinally extending drain channels. Desired longitudinally extending surfaces of these drain channels are provided with a series of closely spaced reliefs for inhibiting tendencies of the core to horizontally bend and fold or collapse, thereby pinching off the vertical drain channels.

20 Claims, 8 Drawing Sheets a. Bent But Not Buckled b. Buckled

PREFABRICATED VERTICAL EARTH DRAIN AND METHOD OF MAKING THE SAME

BACKGROUND OF THE INVENTION

This invention relates generally to soil stabilization, and more particularly to the prefabricated vertical earth drains used to accelerate consolidation of soft clays.

When loads are placed on the surface of soft saturated clay deposits, large settlements often result because of compression of the clay material. This settlement can take place only as pore water is expelled, since the permeability of the clay is very low. This process takes place very slowly. Total settlements of several meters are common and often take years to occur. This time-dependent process is called consolidation. A process called sand drains and surcharging has been used in these cases since the 1920's. See D. E. Moran, U.S. Pat. No. 1,598,300. In this process sand drains or columns are installed through the soft clay layer to be treated. These sand drains are placed on a regular pattern.

After the sand drains are installed, a sand drainage blanket one to three feet thick is placed over the drains to permit water flow out of the drains. An earth embankment is placed over this sand blanket. The thickness of this embankment or surcharge is calculated to produce loading roughly 10% greater than the anticipated final design load planned for the project. Since drainage out of the clay can now flow into the sand drains, the drainage path is much shortened and consolidation occurs much more rapidly. The surcharge is left in place until the consolidation process is nearly complete, typically six months or less. The surcharge is then removed and the project proceeds.

In the late 1960's and early 1970's, vertical wick drains were developed as an alternative to sand drains. Vertical wick drains are not truly wicks, but are composite drains composed of an extruded plastic core, shaped to provide drainage channels when this core is wrapped in a special filter fabric generally referred to as geofabric. The geofabric is a filter fabric constructed with opening sizes such as to prevent the entrance of soil particles, but to allow pore water to enter freely. The finished wick material is band-shaped, is about ⅛ to ¼ inches thick, and approximately 4 inches wide. It is provided in rolls containing 800 to 1000 feet of drain. An example manufacturer of wick drains is American Wick Drain Corporation of Matthews, N.C., U.S.A. Its product is sold under the trademark AMERDRAIN.

Installation is accomplished by means of specialized equipment, consisting of a crane mounted vertical mast housing a special installation mandrel. The mandrel, containing the drain, is intruded directly into the ground from the bottom of the mast. After reaching the desired depth, the mandrel is withdrawn back into the mast, leaving the undamaged drain in place within the soil. For example, see U.S. Pat. No. 5,213,449.

Typical spacings for vertical wick drains are from three to nine or ten feet. This method is very cost effective and has virtually replaced the older sand drain method.

Although many different configurations of plastic core for the composite prefabricated drains are in use, the corrugated type, as pictured in FIG. 1, is one of the most cost effective. This corrugated core 10 of the composite drain 15 is easily and cheaply produced by extrusion of acceptable flexible plastic materials such as polyethylene. The geofabric filter material 20 longitudinally surrounding the core may be manufactured of any accepted material such as non-woven polypropylene filter fabric. Since there are no obstructions to the flow of water within the corrugation channels 11, the flow capacity is very high. The corrugated core shape also provides excellent strength to resist collapse as a result of soil pressure on the drain. This excellent utilization of plastic core material provides cost savings.

As previously described, the purpose of vertical drainage is to facilitate the escape of pore water from within compressible soils, and thus to accelerate soil consolidation. After the drains are installed, a drainage blanket is provided at the ground surface before the load is placed, to provide a continuous flow path for escaping pore water. This initial condition is illustrated in FIG. 2. As the pore water escapes, the soil compresses vertically and settlement occurs. The vertical drains embedded in the soil must also compress in a vertical direction, and this compression is accommodated by buckling or folding of the vertical drain cores as illustrated in FIG. 3. Since soil compression is normally greater near the ground surface, folding is also greater near the ground surface.

When the cores are folded or bent as illustrated in FIG. 3, the material at the outside of each bend must stretch, while that at the inside must compress. Although the core material can conform to a bend as seen in FIG. 4, if the bend becomes too sharp, buckling and folding occurs, as illustrated in FIG. 5, and the drain flattens. In this flattened condition the longitudinal flow channels 11 are pinched off, and water flow is blocked. Buckling or folding appears to occur when the soil reaches a relative compression of about 25% to 30%. Unfortunately, this phenomenon usually occurs near the top, thus impeding the flow from the entire drain.

Although using softer more elastic material for the core would facilitate the buckling or folding problem, strength to prevent collapse from soil pressure would be compromised.

It is a principal object of the present invention to provide such a core of material with longitudinal elasticity to facilitate its ability to bend while maintaining strength to prevent collapse.

SUMMARY OF THE INVENTION

Longitudinal elasticity in the corrugated core is accomplished in accordance with the teachings of the present invention by impressing, cutting or otherwise providing closely spaced impression, serration or slit reliefs in the core. These reliefs can be a series of serrations or impressions which have either a rounded configuration or a sharp configuration, or may be a series of slits that totally pierce the core material.

The prefabricated vertical earth drains of the present invention include an elongated corrugated flexible plastic core sheet having horizontal corrugations providing continuous longitudinally extending drain channels. In accordance with the teachings of the present invention, selected of the longitudinally extended surfaces which comprise the corrugation drain channels, have a series of closely spaced reliefs for inhibiting tendencies of the core to horizontally fold and thereby pinch off the vertical drain channels. Filter fabric generally referred to as geofabric is then provided such that it longitudinally surrounds the core.

The reliefs are generally provided continuously on the selected longitudinally extending surfaces within the drain channels.

The corrugations provide exterior and interior continuous longitudinally extending surfaces in the drain channels of the core. The series of reliefs are generally provided in the exterior surfaces of these channels, but may also be applied to all surfaces, including the interior surfaces of the drain channels.

The object of the relief serrations is to provide a reservoir of plastic material to facilitate the required stretching of the outside surfaces and compression of the inside corrugation surfaces during any imposed bending of the drain core. The amount of stretching or compression will depend on the corrugation depth and sharpness of the imposed bend. The ability of the serrations to provide this function will depend on both their depth and spacing. In general, the serration depth will be on the order of 1/10 to 1/3 of the corrugation depth, and the serration spacing will be close or equal to or less than the width of three or four serration depressions. In fact, the serrations may be serially positioned next to or immediately adjacent each other with no spacing. In any event, the depth of the serrations should be sufficiently large, and the spacing between the serrations sufficiently small to inhibit horizontal folding in the core.

When relief treatment is confined to the exterior corrugation surfaces only, it may take the form of a series of slits. These slits will be spaced at roughly ½ to 1/10 of the corrugation depth.

Serrating the core may be easily accomplished by passing the core between a wheel serrated on its outside perimeter (gear-like) and a hard rubber roller. In this situation, the serrated wheel is sized to fit into the inside of the corrugations in the plastic core, and is placed so that its serrations engage and indent the hard rubber roller. The plastic material of the core is thus permanently deformed and serrated as it passes therebetween. A series of wheels or gears spaced to fit simultaneously within all of the core configurations can be provided to serrate all of the outside surfaces on one side at one time. Another series of serrated wheels or gears can serrate all of the opposite surfaces. this operation can be accomplished with hot core material integrally with the extruding operation, or with cold material in a separate operation. In the case of slits, the wheels may be shaped as punches.

While the composite prefabricated drain of the present invention is adapted particularly for use as a vertical earth drain, nevertheless, there is nothing to prevent the improved drains to also be utilized as prefabricated horizontal drains.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF THE PREFERRED EMBODIMENTS

Figure 1:
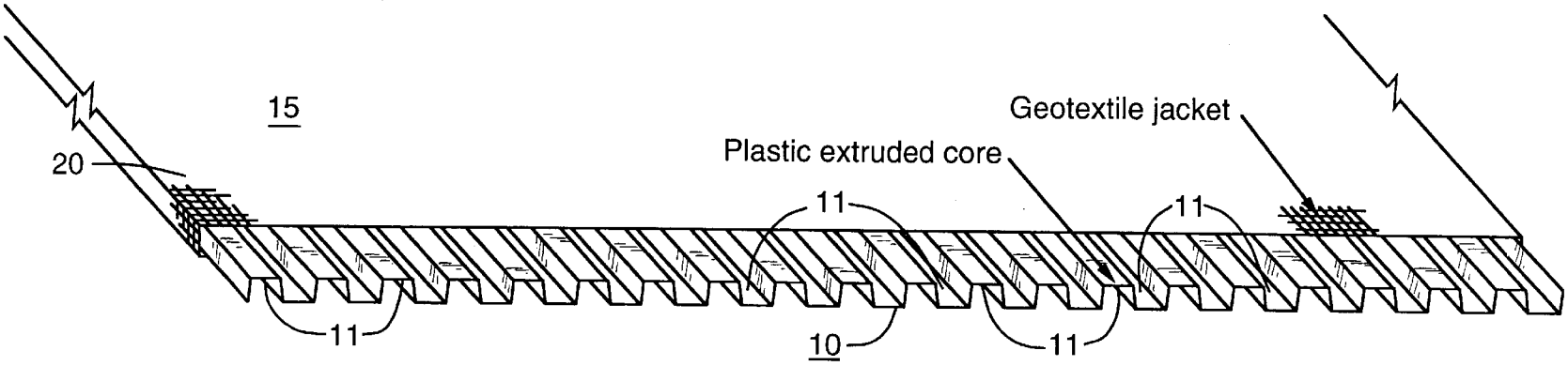
FIG. 1 PRIOR ART
FIG. 1 is an isometric schematic drawing of a corrugated composite prefabricated drain of the prior art.
Figure 2:
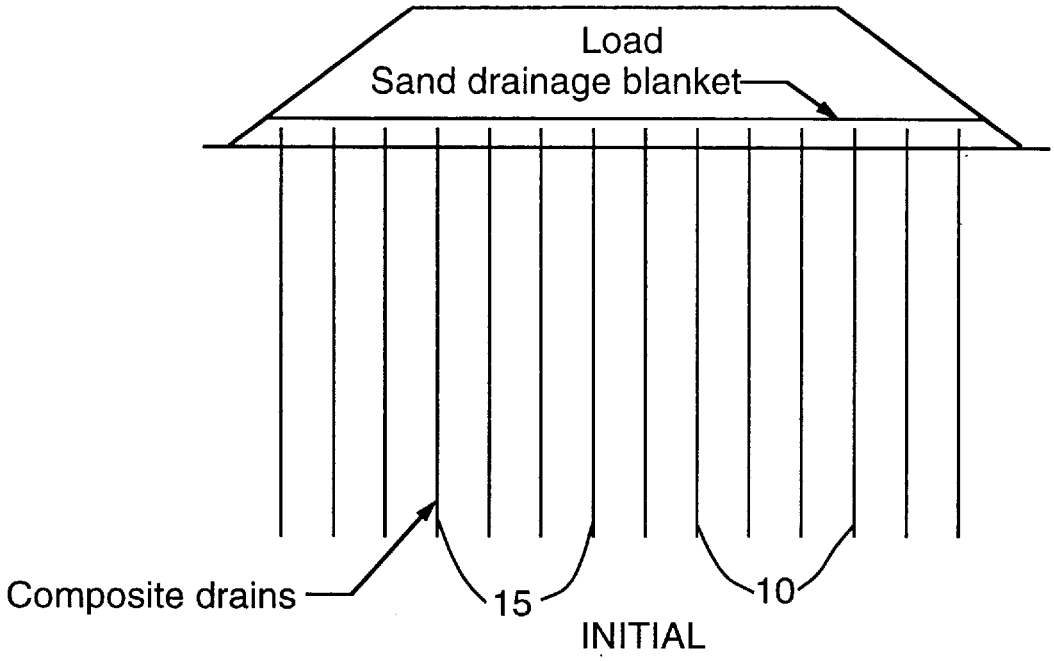
FIG. 2 PRIOR ART
FIG. 2 is a schematic drawing illustrating composite prefabricated vertical drains of the prior art in place in a compressible soil with a drainage blanket and load applied respectively at the ground surface.
Figure 3:
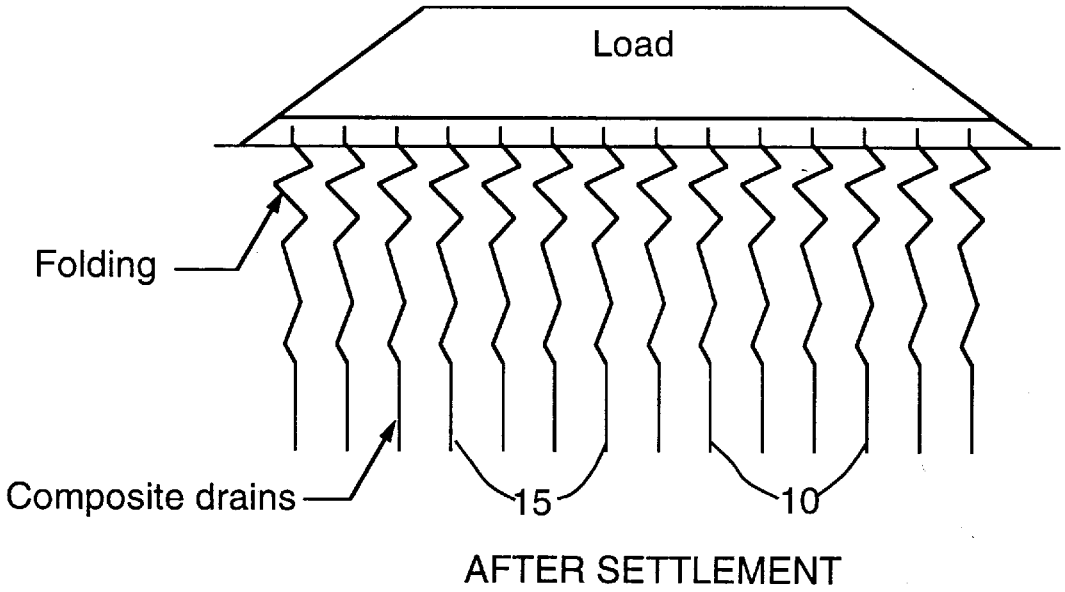
FIG. 3 PRIOR ART
FIG. 3 is a schematic drawing showing the composite prefabricated vertical drains of FIG. 2 after being subjected to vertical soil compression and settlement thereby illustrating folding of the vertical drains.
Figure 4:
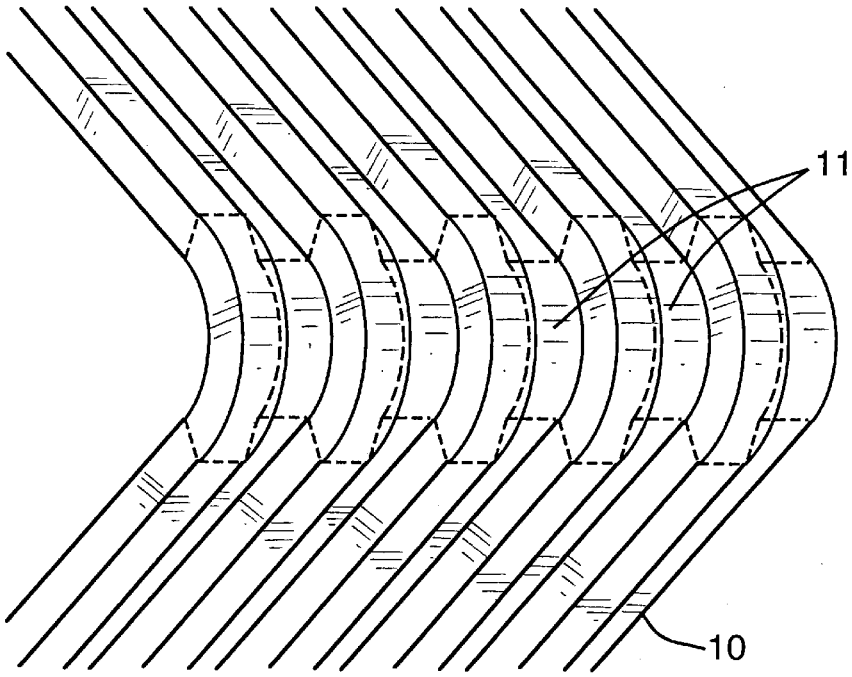
FIG. 4 PRIOR ART
FIG. 4 is an enlarged schematic isometric drawing illustrating a drain of the prior art in a bent, but not buckled condition.
Figure 5:
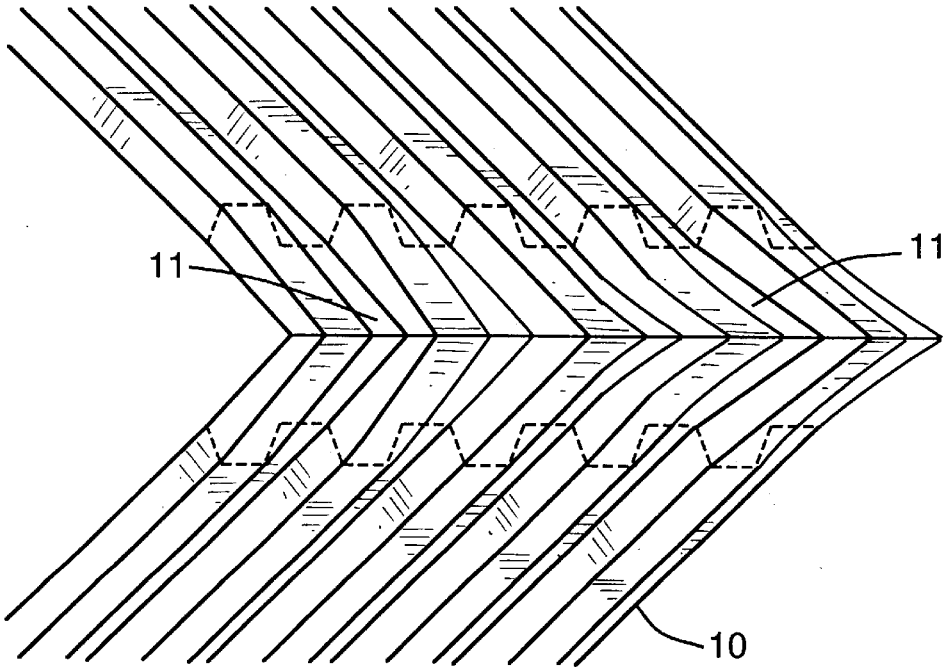
FIG. 5 PRIOR ART
FIG. 5 is an enlarged isometric schematic drawing illustrating a drain core of the prior art in a buckled or folded condition.
Figure 6:
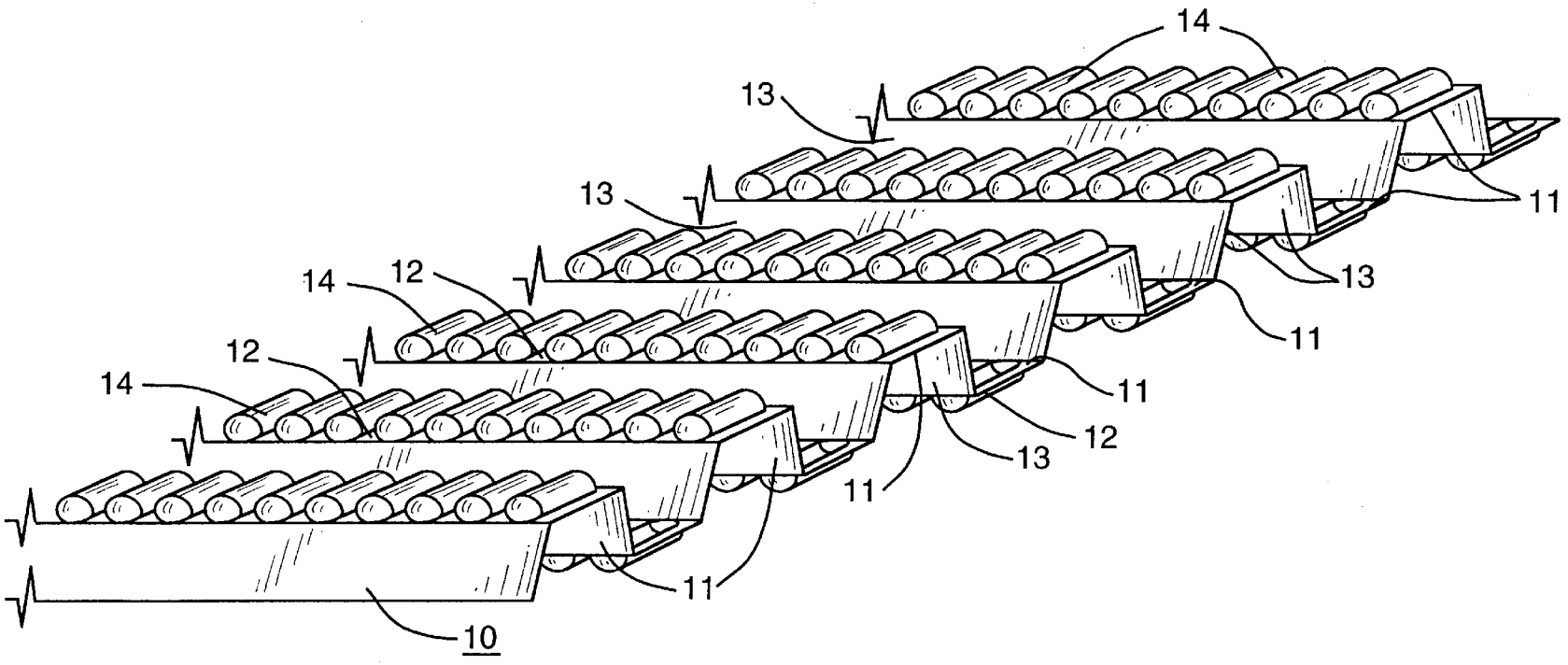
FIG. 6 is an enlarged perspective view of an end portion of one embodiment of the elongated prefabricated vertical earth drain of the present invention shown with rounded serration reliefs.

Referring to FIG. 6, an end portion of an elongated composite vertical earth drain prefabricated in accordance with the teachings of the present invention is illustrated. The composite drain core 10 is illustrated without the applied filter geofabric which normally longitudinally surrounds the core 10 as shown at 20 in the prior art configuration of FIG. 1.

In this embodiment, the core 10 is provided in conventional fashion with horizontal corrugations to provide continuous longitudinally extending respective drain channels 11. These longitudinal drain channels are continuous and extend longitudinally for the entire length of the elongated core. The core, as is explained with regard to the prior art, is basically extruded of a suitable flexible plastic material such as polyethylene in thin sheet corrugated form as illustrated.

The continuous drain channels 11 basically provide exterior continuous surfaces 12 and interior continuous longitudinally extending surfaces 13. In the embodiment of FIG. 6, the exterior surfaces 12 only are provided with serration reliefs 14. The serration reliefs are rounded as indicated and the space therebetween is slightly less than the depression width of any single serration 14.

Figure 7:
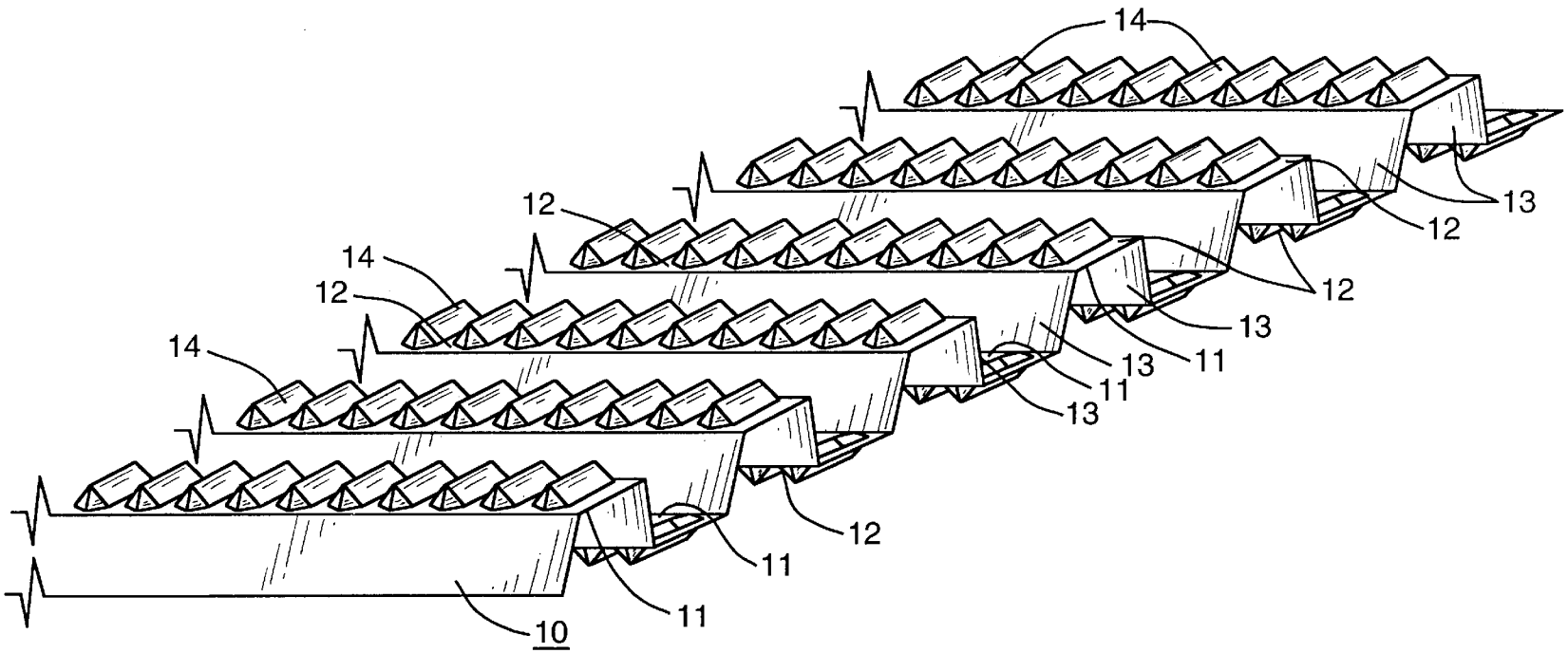
FIG. 7 is an enlarged perspective view of an end portion of another embodiment of the elongated prefabricated vertical earth drain of the present invention illustrated with sharp serration reliefs.
Figure 10:
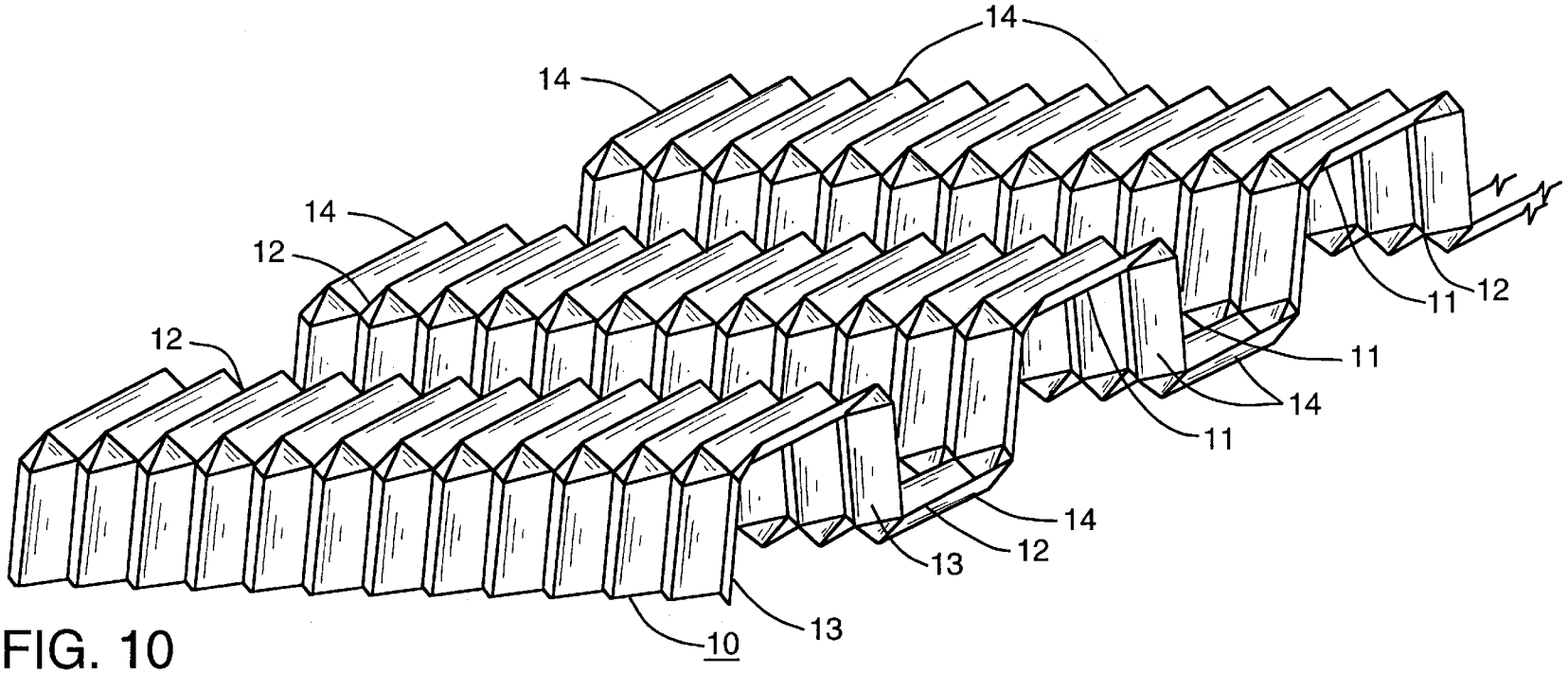
FIG. 10 is an enlarged perspective view of an end portion of another embodiment of the composite prefabricated vertical earth drain of the present invention as provided with serration reliefs in accordance with the teachings of the present invention on all surfaces thereof.

In the embodiment of FIG. 7, the serration reliefs are shown as sharp or angled serrations 14, instead of the rounded serrations illustrated in FIG. 6. The spacing between serrations 14 should be sufficiently close to prevent horizontal folding in the core 10. Accordingly, the close spacing between serration reliefs should be at most approximately equal to four times, and more preferably less than, the width of a single serration relief depression. In fact, the serrations can be continuous or immediately adjacent each other as illustrated in the embodiment of FIG. 10 which will be discussed in more detail hereinafter. Relief depression depth will normally be 1/3 to 1/10 of the depth of one corrugation depth.

Figure 8:
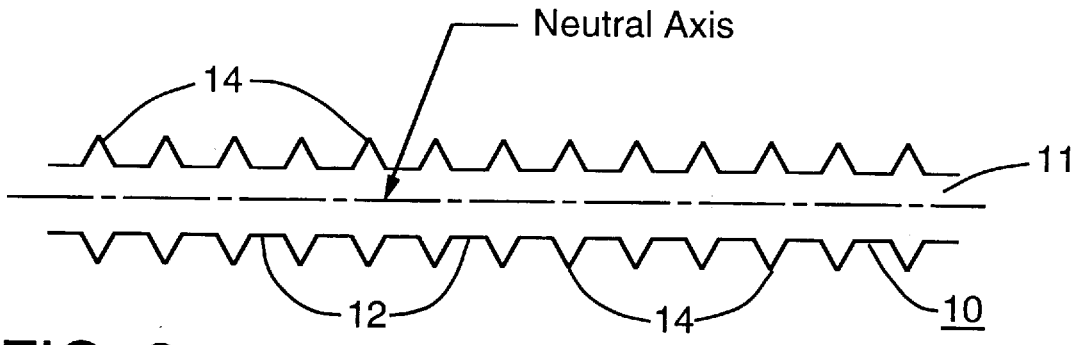
FIG. 8 is a schematic diagram illustrating serration reliefs applied to the prefabricated drain core in accordance with the teachings of the present invention.
Figure 9:
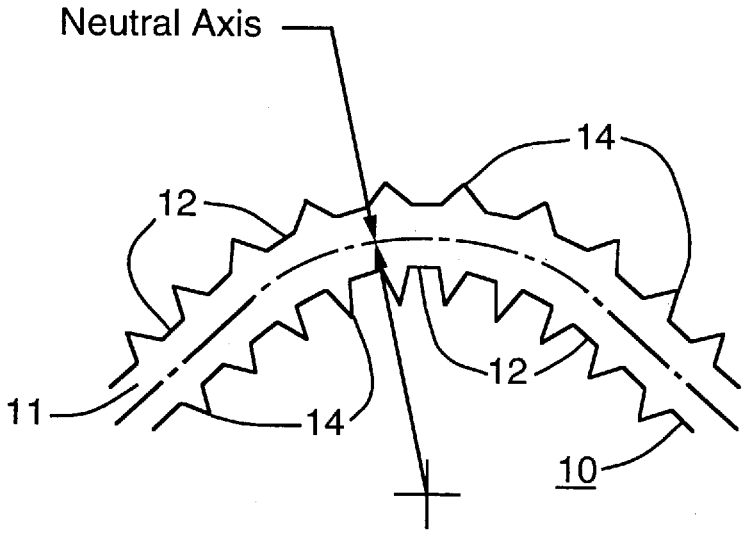
FIG. 9 is a schematic diagram illustrating the effect of bending on the serrated core illustrated in FIG. 8.

The effect of providing the serration reliefs 14 for substantially increasing the ability of the core 10 to inhibit tendencies of horizontal folding is illustrated schematically in FIGS. 8 and 9.

Here in FIG. 8, opposite exterior channel surfaces 12 are schematically illustrated in a straight unbent condition for the core 10. Then in FIG. 9, the channel with its serrated relieved surfaces is illustrated in a bent condition along its indicated neutral axis. It can be seen from FIG. 9 that the longitudinal elasticity in the core material is greatly enhanced to facilitate its ability to bend while maintaining strength to prevent collapse and folding due to the accordion effect of the applied serration reliefs.

The vertical drain core of the present invention as illustrated in FIG. 10, illustrates yet another embodiment of the corrugated plastic core of the prefabricated vertical drain of the present invention. In this configuration, all sides on both interior and exterior surfaces 11 and 12 of the channels 11 are provided with the serration reliefs, thereby providing even more flexibility of the core in its longitudinal direction without succumbing to horizontal folding or creasing.

Figure 11:
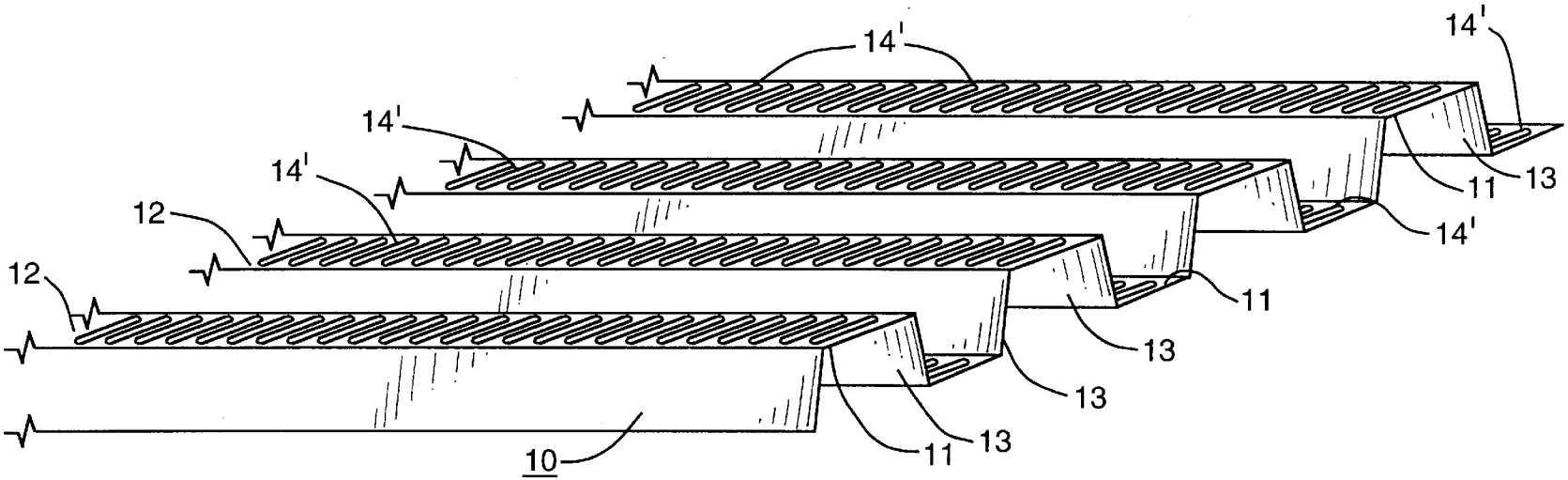
FIG. 11 is a schematic diagram illustrating slit reliefs cut in the exterior surfaces of the drain corrugations.

In FIG. 11, the reliefs are provided by a series of slits 14' in the exterior surfaces of the corrugations. These slits function in the same manner as the serrations in providing enhanced elasticity in the external fibers. Obviously, the application of slits can be utilized in the exterior surfaces only. A combination of serration and slit reliefs may also be utilized.

Possible methods available for providing these serrations or slits on the core have already been described in the Summary of Invention. Other methods are of course possible for creating the serration or slit reliefs.

I claim:

1. A prefabricated vertical earth drain including an elongated corrugated flexible plastic core sheet having horizontal corrugations providing continuous longitudinally extending drain channels defined with longitudinal corrugation corner bends, the improvement comprising selected longitudinally extending surfaces between adjacent corner bends of said channels having a series of closely spaced reliefs confined within said selected surfaces without impinging on said corner bends for inhibiting tendencies of the corrugated core sheet to horizontally fold and thereby pinch off said vertical drain channels.

2. The prefabricated vertical earth drain of claim 1 including filter fabric longitudinally surrounding said corrugated sheet core.

3. The prefabricated vertical earth drain of claim 2 wherein said reliefs are provided continuously on said selected longitudinally extending surfaces.

4. The prefabricated vertical earth drain of claim 3 wherein said corrugations provide exterior and interior continuous longitudinally extending surfaces in said channels, said reliefs being provided in said exterior surfaces.

5. The prefabricated vertical earth drain of claim 4 wherein said reliefs are provided in the form of serrations.

6. The prefabricated vertical earth drain of claim 5 wherein said serrations are also provided in said interior surfaces.

7. The prefabricated vertical earth drain of claim 5, wherein said serrations are spaced at a distance from each other which is approximately equal to or less than the width of four of said serrations.

8. The prefabricated vertical earth drain of claim 7 wherein the depth of said serrations is approximately ⅓ to ⅒ the depth one of said corrugations.

9. The prefabricated vertical earth drain of claim 4 wherein said reliefs are provided in the form of slits.

10. The prefabricated earth drain of claim 9, wherein said slits are spaced at a distance from each other which is approximately equal to or less than ½ the depth of one of said corrugations.

11. A method of fabricating vertical earth drains comprising the steps of: extruding elongated sheets of flexible plastic with horizontal corrugations providing continuous longitudinally extending drain channels, and relieving selected longitudinal surfaces of said drain channels within the confines of said selected surfaces and thereby providing such surfaces with a series of closely spaced reliefs for inhibiting tendencies of the corrugated sheets to horizontally fold and thereby pinch off said longitudinal drain channels.

12. The method of claim 11 including the step of longitudinally surrounding said corrugated core sheet with filter fabric following the step of relieving.

13. The method of claim 12 wherein the step of relieving is carried out to continuously provide said reliefs on said selected longitudinally extending surfaces.

14. The method of claim 13 wherein the step of extruding is carried out to provide exterior and interior continuous longitudinally extending surfaces in said channels, and the step of relieving is carried out on said exterior surfaces.

15. The method of claim 14 wherein the step of relieving is carried out by providing said reliefs in the form of serrations.

16. The method of claim 15 wherein the step of relieving is also carried out on said interior surfaces.

17. The method of claim 16 wherein the step of relieving includes the step of spacing said serrations at a distance which is approximately equal to or less than the width of four of said serrations.

18. The method of claim 17 wherein the step of relieving includes the step of providing the depth of said serrations to be ⅓ to ⅒th of the depth of one of said corrugations.

19. The method of claim 13 wherein the step of relieving includes the step of providing said reliefs in the form of slits.

20. The method of claim 19 wherein the step of relieving includes the step of spacing said slits at a distance which is approximately equal to or less than ½ the depth of one of said corrugations.

* * * * *